US005875862A

United States Patent [19]

Jurewicz et al.

[11] Patent Number: 5,875,862

[45] Date of Patent: Mar. 2, 1999

[54] POLYCRYSTALLINE DIAMOND CUTTER WITH INTEGRAL CARBIDE/DIAMOND TRANSITION LAYER

[75] Inventors: Stephen R Jurewicz, So. Jordan; Kenneth M Jensen, Orem, both of Utah

[73] Assignee: U.S. Synthetic Corporation, Orem, Utah

[21] Appl. No.: 892,376

[22] Filed: Jul. 14, 1997

Related U.S. Application Data

[63] Continuation of Ser. No. 502,821, Jul. 14, 1995, abandoned.

[51] Int. Cl.[6] ..... E21B 10/46

[52] U.S. Cl. ..... 175/432; 51/293

[58] Field of Search ..... 175/432, 431, 175/428, 430, 434, 433; 51/293, 295

[56] References Cited

U.S. PATENT DOCUMENTS

| | | | |
|---|---|---|---|
| 4,529,048 | 7/1985 | Hall | 175/432 |
| 4,629,373 | 12/1986 | Hall | 175/434 X |
| 5,011,515 | 4/1991 | Frushour | 51/307 |
| 5,351,772 | 10/1994 | Smith | 175/428 |
| 5,355,969 | 10/1994 | Hardy et al. | 175/432 |
| 5,370,717 | 12/1994 | Lloyd et al. | 51/293 |
| 5,379,854 | 1/1995 | Dennis | 175/434 |
| 5,469,927 | 11/1995 | Griffin | 175/432 |
| 5,486,137 | 1/1996 | Flood et al. | 175/433 X |
| 5,492,188 | 2/1996 | Smith et al. | 175/432 |
| 5,564,511 | 10/1996 | Frushour | 175/431 |
| 5,590,728 | 1/1997 | Matthias et al. | 175/432 |
| 5,598,750 | 2/1997 | Griffin et al. | 76/108.2 |

FOREIGN PATENT DOCUMENTS

| | | | |
|---|---|---|---|
| 2283772 | 5/1995 | United Kingdom | 175/432 |

*Primary Examiner*—Hoang C. Dang
*Attorney, Agent, or Firm*—Lloyd W. Sadler

[57] ABSTRACT

A composite body cutting instrument formed of a polycrystalline diamond layer sintered to a carbide substrate with a carbide/diamond transition layer. The transition layer is made by creating carbide projections perpendicular to the plane of the carbide substrate face in a random or nonlinear orientation. The transition layer manipulates residual stress caused by both thermal expansion and compressibility differences between the two materials and thus increases attachment strength between the diamond and carbide substrate by adjusting the pattern, density, height and width of the projections.

29 Claims, 8 Drawing Sheets

POLYCRYSTALLINE DIAMOND CUTTER WITH INTEGRAL CARBIDE/DIAMOND TRANSITION LAYER

This application is a continuation of U.S. application Ser. No. 08/502,821, filed Jul. 14, 1995, of Stephen R. Jurewicz for POLYCRYSTALLINE DIAMOND CUTTER WITH INTEGRAL CARBIDE/DIAMOND TRANSITION LAYER, now abandoned.

BACKGROUND OF THE INVENTION

1. Field of the Invention

This invention relates generally to wear and impact resistant composite bodies such as those used in drilling, cutting or machining hard substances. More specifically, the present invention provides an improved transition zone between a layer of super-hard material and a substrate. The super-hard material in this case is a sintered polycrystalline diamond (PCD) which is fixed to a substrate such as cemented metal carbide composite. The transition zone between the diamond and carbide substrate is an inherently vulnerable area which is often the source of failure of the composite body due to residual stresses created as a result of the manufacturing process. The invention uses the residual stress to benefit the composite body instead of trying to eliminate it.

2. Prior Art

Polycrystalline diamond compacts (PDCs) are diamond layers fixed to substrates. Generally, PDCs provide a hard drilling and cutting surface for use in the mining and machining industries. Specifically, they provide high resistance to wear and abrasion having the strength of diamond and the toughness of a carbide substrate.

Individual layers of the PDC, however, do not share all of the characteristics of the composite body. For example, while polycrystalline diamond is very strong and abrasion resistant, it is not very tough. The quality of toughness is quantified in the measurement of impact resistance. Impact resistance is of vital concern to the oil and natural gas mining industry because of the high impact and high abrasion environments encountered while drilling through various layers of rock.

A harsh working environment is not the only problem encountered by users of PDCs. The conventional process of fixing the polycrystalline diamond to the substrate causes the development of high internal residual stresses between the different layers during high pressure and high temperature formation. These stresses are the result of thermal expansion and modulus differences between the diamond layer and the substrate. Thus, residual stresses can add to the problem of the already low impact resistance of diamond layers.

What is needed is a way to couple the polycrystalline diamond layer to the substrate in such a way as to modify the internal stresses in the transition zone such that they improve the PDC's performance rather than detract from it. Modification of residual stresses in the transition zone can also improve the initial stress state on the cutting edge of the PDC. This provides increased impact resistance, and consequently extends the useful life of the PDC.

The prior art technique for the sintering of diamond and fixing it to a tungsten carbide substrate is demonstrated by U.S. Pat. No. 3,745,623. The transition zone between the PCD and the substrate is abrupt. An abrupt transition zone is inherently weak, especially when the transition layer must withstand stresses up to about 200,000 psi. In general, PDCs have residual interface stresses from formation of about 80,000 to 150,000 psi, making the strength of the interface critical to maintain PDC integrity.

As stated above, modifying residual interface stresses can increase overall PDC strength. One method of increasing the PDC strength is illustrated by U.S. Pat. No. 4,604,106 which teaches, among other things, the use of one or more transition layers composed of mixtures of pre-sintered tungsten carbide and diamond. By varying the percentage of diamond and carbide in the layers, the residual stress is reduced in stages throughout the transition layers. However, one of the drawbacks of this technique is that because the sintering process apparently depends on the migration of liquid cobalt from the carbide substrate into the diamond powder, the transition layers may inhibit this process, resulting in a diamond surface with reduced abrasion resistance.

A different technique for modifying residual stress is disclosed in U.S. Pat. No. 4,784,023 wherein linear grooves in the carbide substrate increase drilling performance. However, the grooving of the substrate was not intended to reduce internal stress in the PDC. The grooves are oriented such that they engage the workpiece face during the drilling operation. This orientation has the effect of making the stress field non-uniform, possibly leading to PDC cracking, especially in a plane parallel to the grooves. In addition, the grooves cause internal stresses of their own due to non-uniform sintering during the high pressure and temperature fixing process. The result is less dense sintered diamond areas. This phenomenon leads to substantial instances of cracking when the cutters are brazed into the bits.

U.S. Pat. No. 4,629,373 appears to get around the problem of stresses at a transition zone between a polycrystalline diamond layer and a substrate by eliminating the substrate. For example, the diamond layer is brazed directly into a tool holder or other support device. However, brazing is a weaker bond than the one created by the high pressure and temperature process used in the present invention to bond the diamond layer to a substrate. Furthermore, without the substrate, the tool cannot be used in high impact or high force situations which a carbide substrate is designed to withstand.

A different approach to the problem is taught in U.S. Pat. No. 5,011,515 where one aspect of the invention is a technique for modifying the topography of the carbide substrate to create a transition zone comprised of carbide and diamond. Specifically, a three dimensional pattern of irregularities on the surface of the substrate taper into the diamond layer are provided in an attempt to spread out the residual internal stresses over a larger surface area to achieve a more impact resistant PDC. However, the irregularities can act as wedges, forcing the diamond and carbide apart.

U.S. Pat. No. 5,351,772, among other things, appears to present a method of modifying the residual stresses through the use of raised carbide lands disposed on the carbide upper surface, over which the diamond is sintered. While the idea of redistributing the stresses through the use if radial lands is beneficial, freedom to optimize stresses is less pronounced than using the projections of the present invention. As will be explained, the ability to vary density, height and location of the projections in the current invention is more pronounced. Furthermore, this prior art appears limited to complete coverage of the lands, whereas the present invention will be shown to allow projections to penetrate the diamond surface, providing highly compressed areas to arrest crack propagation and to allow further load bearing capacity on the top diamond surface.

Finally, U.S. Pat. No. 5,355,969 discloses the use of surface irregularities to reduce residual stress between the polycrystalline diamond layer and the carbide substrate. Specifically, the patent teaches how alternating projections and depressions spaced apart in a radial pattern of concentric circles around the center of the tool can increase the surface area for attachment between the diamond layer and substrate. However, the design is limited to radial patterns, and does not address itself specifically to modifying residual forces in such a way that they increase PDC performance. In addition, the projections are all of equal height, and the depressions of equal depth, doing nothing to manipulate residual stress in a beneficial manner.

In effect, this patent and all those mentioned above focus on spreading out the residual stress over the largest area possible. The major drawback is ignoring the possible benefits that can come from strategically arranging the projections that will result in concentrated residual stress in specific and predetermined areas. Thus, it would be an advantage over the prior art to provide a technique for creating a transition zone between a polycrystalline diamond layer and a carbide substrate that will modify residual stress patterns such that an inherent problem with PDCs can be turned into an advantage. For example, materials under compressive stress can be many times stronger than materials under no stress.

Another problem that has yet to be addressed are the types of stresses on the components of the PDC itself, including, but not limited to the transition zone. Specifically, the carbide layer endures tensile stresses that tend to deform the carbide by pulling the carbide substrate apart, and the diamond layer endures both tensile and compressive stresses which tend to deform the diamond layer by pulling the diamond layer apart in some areas while compressing the diamond layer in other areas. While the compression on the diamond is beneficial, the tensile forces on the diamond and carbide are very detrimental.

It would also be an advantage if the present invention could also strategically modify tensile and compression forces so that the PDC could endure higher loading.

OBJECTS AND SUMMARY OF THE INVENTION

It is an object of the present invention to provide a transition zone between a body comprising a polycrystalline diamond layer and a carbide substrate that will modify the residual stress pattern in the transition zone thereby increasing effectiveness of the body as a tool.

It is another object to provide a transition zone between a body comprising a polycrystalline diamond layer and a carbide substrate that will result in increased attachment strength between the materials.

It is yet another object of the present invention to provide a transition zone that can better withstand residual stress resulting from different rates of thermal expansion of the polycrystalline diamond layer and carbide substrate.

Still another object is to provide a transition zone that can better withstand residual stress resulting from different rates of compressibility of the polycrystalline diamond layer and carbide substrate.

Yet another object of the invention is to provide a method and apparatus for reducing tensile stresses within the carbide substrate to further increase the load bearing capacity of the PDC.

Still yet another object of the invention is to provide a method and apparatus for moving compression and tensile stresses within the polycrystalline diamond layer and the carbide substrate to further increase the load bearing capacity of the PDC.

These and other objects and advantages of the present invention will be set forth and disclosed in the detailed description. A specific illustrative embodiment is a composite material body comprising a polycrystalline diamond layer and a carbide substrate layer having a transition zone between the layers for securing them together. The transition zone is formed by modifying the topography of the cemented carbide surface in such a manner as to provide a plurality of cemented carbide projections rising substantially perpendicular from the carbide substrate and into the polycrystalline diamond layer. The projections do not significantly taper in width, and do not have angular sides. This structure is a result of the benefits it provides for the composite body as well as a desire to have efficient manufacturing. Specifically, creating the projections in this manner minimizes forces that would push the diamond layer and carbide substrate apart when subjected to thermal and compression forces. It also creates a manufactured part which is easily removed from a die cast or mold. Likewise, residual stress can be modified by the specific arrangement or pattern of carbide projections on the substrate, as well as using a combination of projections of varying heights and widths to modify residual stress in three dimensions.

When the optimum pattern of carbide projections has been determined for a particular application, the substrates can be formed by a carbide manufacturer using standard carbide powder pressing techniques that are well known to those skilled in the art. Specific details of the process will be deferred to the detailed description section.

Also disclosed in this patent is a method for creating a transition zone in a body of polycrystalline diamond with a carbide substrate that alters residual stress levels within the transition zone. This method comprises the steps of a) manufacturing a carbide substrate with a plurality of carbide projections attached to and perpendicular to the top surface of the substrate, where the projections have a minimal taper, and b) sintering a polycrystalline diamond layer to the carbide substrate such that the carbide projections are surrounded by the diamond layer.

Also disclosed is a method for arranging these projections so as to manipulate the tensile and compressive stresses within the diamond and carbide layers. The method comprises the steps of a) manufacturing a carbide substrate with a plurality of carbide projections attached to and perpendicular to the top surface of the substrate at strategic locations thereon, and b) sintering a polycrystalline diamond layer to the carbide substrate such that the carbide projections are surrounded by the diamond layer so as to move compressive stresses on the diamond surface toward an outer edge, thereby replacing tensile stresses on the diamond table with compression stresses to increase load bearing capacity on the perimeter of the PDC.

The above and other objects, features, advantages and alternative aspects of the invention will become apparent from a consideration of the following detailed description presented in connection with the accompanying drawings.

DETAILED DESCRIPTION

Reference will now be made to the drawings in which the various elements of the present invention will be given numerical designations and in which the invention will be discussed so as to enable one skilled in the art to make and use the invention.

The figures refer to composite structures or bodies made of a polycrystalline diamond layer formed on a cemented carbide substrate. Polycrystalline diamond is sintered onto the carbide substrate, and should be understood to include, but not be limited to, any sintered synthetic or natural diamond product in which there is substantial diamond-to-diamond bonding. The term cemented carbide refers to any carbide from the group IVB, VB, or VIB metals which are pressed and sintered in the presence of a bonder metal of cobalt, nickel, iron or any alloy combination thereof. Additional metals and/or carbides, for example Ta, TaC, Ti, TiC, Zr, or ZrC, may be added to the metal carbide binder mixture to enhance the mechanical properties.

Figure 1:
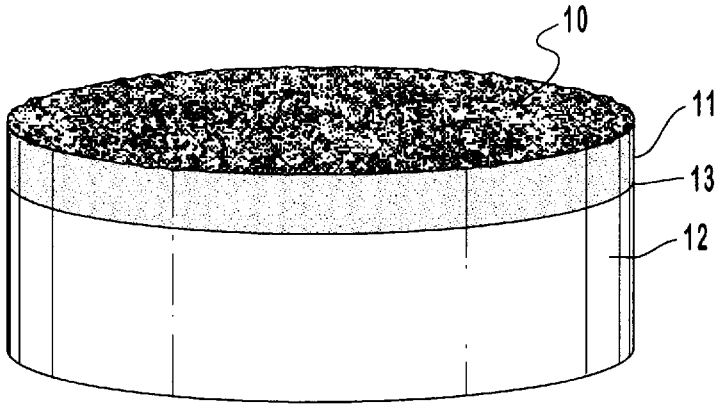
FIG. 1 (PRIOR ART)
FIG. 1 is a perspective, phantom view illustrating the prior art technique of a finished composite body of a polycrystalline diamond and a carbide substrate.

Referring to FIG. 1, there is shown a perspective view of the typical prior art design of composite bodies 10 formed of a layer of polycrystalline diamond 11 and a carbide substrate 12. The important feature is the abrupt transition between these materials. The problem inherent in the design is that the transition zone 13 already has residual interface stresses between 80,000 to 150,000 psi as a result of manufacturing. A highly stressed transition zone 13 results in a smaller external force being able to delaminate the body 10, thereby causing catastrophic failure of the composite body 10 as the diamond layer 11 is sheared off.

Figure 2:
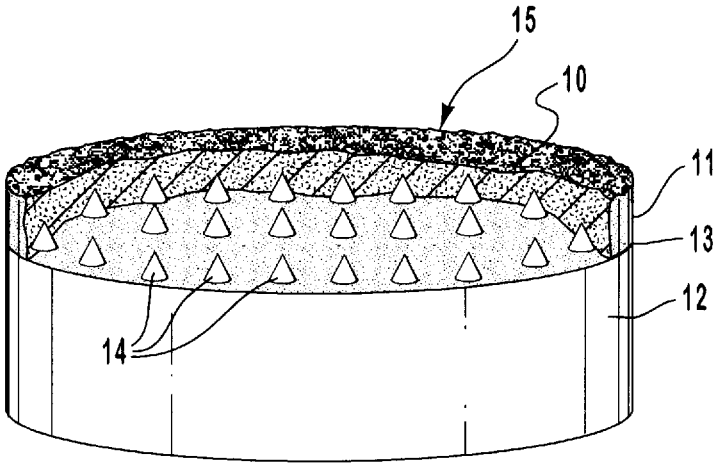
FIG. 2 (PRIOR ART)
FIG. 2 is a perspective, phantom view illustrating an alternative embodiment of the prior art of FIG. 1.

FIG. 2 illustrates an attempt to increase the strength of the transition zone by forming carbide projections 14 rising out of the carbide substrate 12 that pierce the diamond layer 11 above. As noted earlier, one of the drawbacks to this design is a property inherent in the materials used. Different thermal expansion rates result in the carbide projections 12 pressing on the diamond layer 11 above. The residual and thermal stresses act to force the diamond and carbide apart due to steep side taper on the projections, resulting in catastrophic failure of the composite body 10.

Figure 3A:
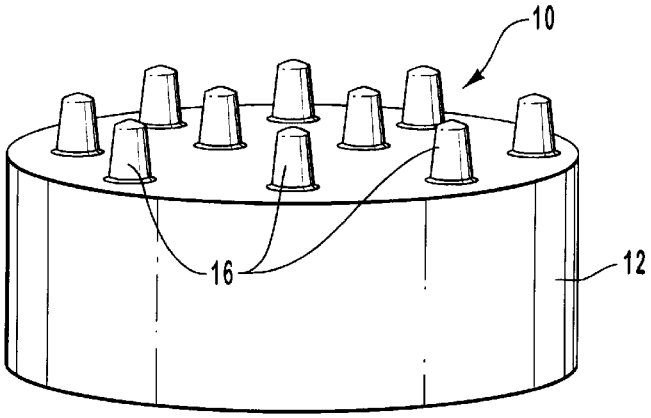
FIG. 3A is a perspective, phantom view of a carbide substrate made in accordance with the principles of the present invention.

FIG. 3A is an illustration of the preferred embodiment of the present invention. The intent of this invention is not to distribute the residual stress over as wide an area as possible, but to tailor the stress concentrations into areas which will add to the performance of the composite body 10. Stress concentrations are modified by altering the position, density, height, and width of the projections 16 on the carbide substrate 12. Thus, the shape of the carbide projections 16 may be uniform, random, or specifically engineered to create a preferred residual stress pattern. In the embodiment shown, the distribution of the projections 16 is generally uniform, as well as their height and width.

The exact type of stress modification achieved with the present invention is as varied as the possible number of patterns of projections on the carbide substrate. For example, varying the position of projections such as grouping them at particular locations results in residual stress reduction in some areas, but not in others. Conversely, the position of projections can be changed to strategically increase residual stress in some locations, while decreasing it at others. Density of projections can likewise change residual stress patterns.

Figure 4A:
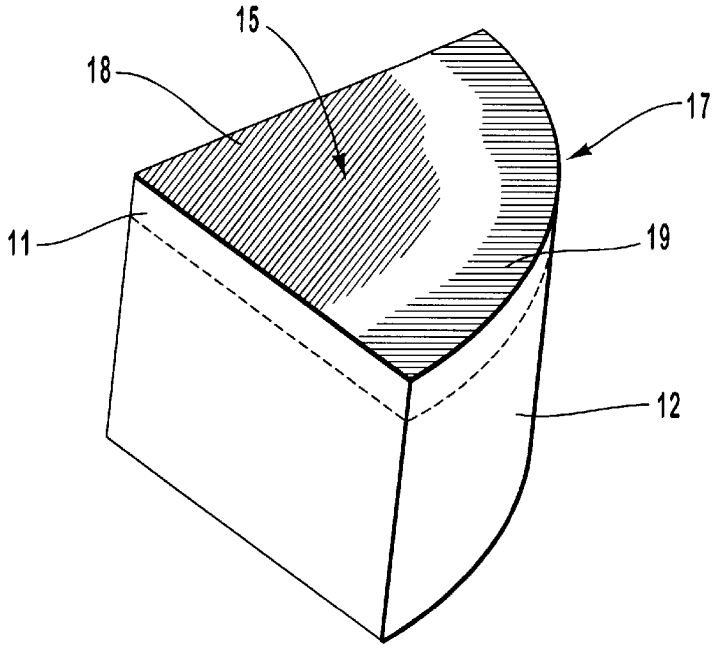
FIG. 4A is a perspective view of the stress fields generated in a quarter section of a PDC without the improvements of the present invention.
Figure 4B:
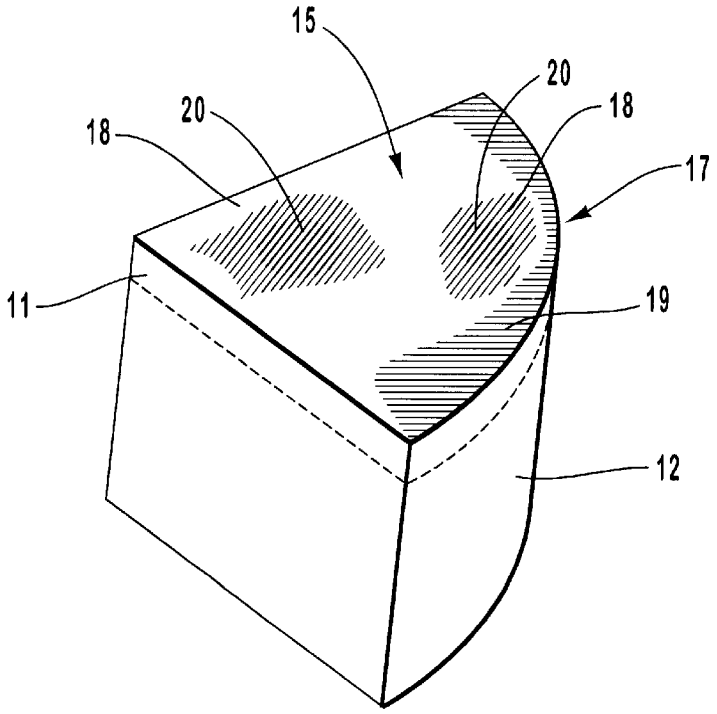
FIG. 4B is a perspective view of the stress fields generated in a quarter section of a PDC with two projections on the carbide substrate.

In addition, an object of the present invention is to move compression and tensile stresses within the polycrystalline diamond layer and the carbide substrate to alter the load bearing capacity of the PDC as is illustrated by comparison in quarter-view PDC FIGS. 4A and 4B.

Figure 3B:
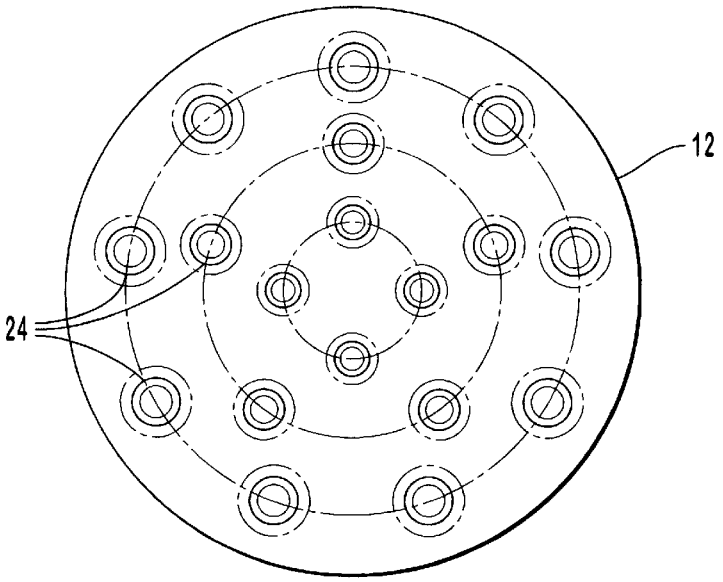
FIG. 3B is a top view of a carbide substrate showing a pattern of carbide projections arranged in accordance with the principles of the present invention.

FIG. 3B is a top view of a pattern of projections 24 arranged on the carbide substrate 12 which mates to the diamond layer or table 11 above it. The figure is provided to illustrate the relative randomness of the projections 24. The concentric circles are created mainly because of manufacturing constraints. However, the figure is only illustrative of a possible pattern. The present invention is not restricted to a specific pattern of projections 24 other than as described in the claims herein.

Figure 3C:
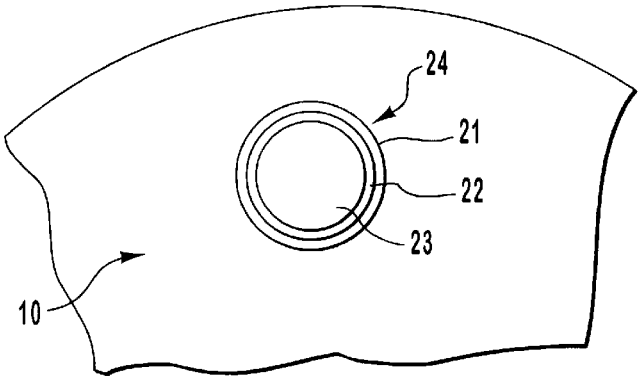
FIG. 3C is a top cut-away view of a projection of the present invention shown in FIG. 3A.

FIG. 3C illustrates another important feature of the projections 24 not readily apparent from FIGS. 3A and 3B. Specifically, the base 21, the sidewall 22 and top 23 are generally circular, and substantially form a cylinder with a single sidewall 22, meaning there is no vertical edge along the sidewall 22. The projections 24 are not true cylinders, however, because they taper slightly, being thicker at the base 21 of the projections 24 than at the top 23. The reason for the taper is a manufacturing process constraint. The composite bodies 10 are preferably manufactured using a pre-formed powder compaction technique. This technique requires that the side walls of the projections 24 taper. This taper allows the projections 24 to be ejected from a die without destroying the tops 23 of the projections 24. The taper is generally 5 to 10 degrees to facilitate removal from the die, although angles up to 20 degrees may prove beneficial without introducing the problems previously mentioned. Nevertheless, it is also possible for the projections 24 to have a vertical sidewall 22 if the projections 24 are cut from the substrate itself.

In addition, while the tops 23 of the projections 24 are generally rounded, there may be applications where flat or chamfered tops 23 may be desired. It is important, however, to avoid projection 24 designs with sharp edges because they concentrate stress and become prime sites for crack initiation.

While the preferred embodiment encompasses round cylindrical carbide projections 24 as shown in FIG. 3D, such a shape is preferred because it facilitates manufacturing of the carbide substrate. Nevertheless, the shape of the projections may take other forms. However, because angled edges are to be avoided, the projections should have cross sections of ellipsoids such as an oval or circle.

In one embodiment of the manufacturing process of the composite body, diamond powder is sintered onto the carbide substrate by loading approximately 1 gram of diamond powder into a refractory metal cup or container having a width of about 19 millimeters (mm). A carbide substrate is placed in the powder-filled cup with the surface projections pressed down into the diamond powder. The cup is then compressed with a hydraulic press to compact the diamond powder as much as possible. The compressed cup is then surrounded by a two part metal container which effectively seals the cup from any outside impurities. The sealed container is then placed in a vacuum furnace below 100 microns of vacuum and heated to approximately 600 degrees Celsius to remove any impurities. After firing, the assembly is loaded into a high pressure hexahedral cell and compressed to greater than 45 kilobars of pressure and exposed to temperatures in excess of 1300 degrees Celsius. It should be noted that a "belt" style high pressure apparatus may also be used to generate pressure and temperature sufficient for this process. The pressure and temperature to which the assembly is subjected are conditions within the thermodynamic stability of diamond, and above the melting of cobalt. The diamond powder sinters as the liquid cobalt from the cemented carbide substrate infiltrates into the pore spaces of the powder. The liquid metal is capable of dissolving carbon at high energy areas, and then precipitating the carbon (as diamond) into low energy areas resulting in diamond-to-diamond bonding between the individual diamond grains. In addition, small amounts of powdered metals may be blended into the diamond powder as needed to facilitate compaction and sintering. After approximately five minutes, the assembly is cooled and the pressure released. The raw sintered blank is then finished by lapping or electrode discharge grinding the diamond layer to the appropriate thickness, and then grinding the outside diameter to the required final dimension.

It should be remembered that the above process is illustrative only, and various size composite bodies are produced for different applications.

FIGS. 4A and 4B are provided to illustrate the change in residual stresses which occur by the introduction of projections made in accordance with the present invention. In FIG. 4A, no projections are present in the carbide substrate of composite body 17. The polycrystalline diamond of the body 17 is in compression near the center of the diamond table 11 as indicated by the set of lines marked as 18, while the diamond table 11 near the edge is in tension as indicated by the set of lines marked as 19. Before the introduction of projections onto the carbide substrate, compression stresses 18 are substantially focused on the center of the diamond face 15, and tensile stresses 19 are substantially focused on the outer edges of the diamond table 11.

A first advantage of strategic placement of the projections is that the compression stresses 18 can be pushed from the center of the diamond face 15 out to the edges as test results illustrate in FIG. 4B. FIG. 4B shows how two carbide projections 20 under the diamond layer can alter stresses. Replacing tensile stresses 19 with compression stresses 18 near the edge of the PDC body 17 greatly increases the load bearing capacity of the PDC 17 because the outer edges of the diamond table 11 are the point of greatest loading. The area of tensile stress 19 is therefore reduced or eliminated. Another advantage is that tensile stresses 19 in the interior (not shown) of the carbide substrate 12 are slightly reduced. A further advantage is that tensile stresses 19 are also reduced or eliminated in the carbide substrate 12 on the outer perimeter of the PDC 17, just below the diamond/carbide interface (not shown).

It should be realized from the description of FIG. 4B that tensile stresses 19 can be removed from the entire surface 15 of the diamond table 11 after careful arrangement of carbide projections 20. Furthermore, compression stresses 18 can be moved so as to take the place of the tensile stresses 19, thereby improving the load bearing capacity of the PDC 17.

Figure 5:
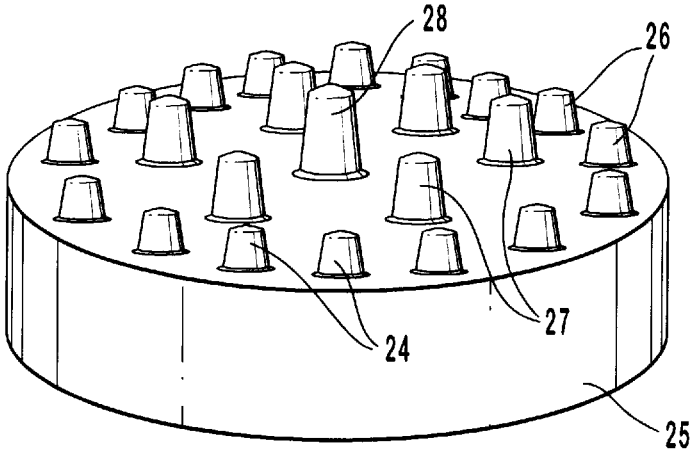
FIG. 5 is a perspective, phantom view illustrating an alternate embodiment of the carbide substrate seen in FIG. 3.

FIG. 5 shows an alternative arrangement of carbide projections extending from the carbide substrate 25. Unlike FIG. 3 where the projections 24 are of uniform height, the projections 24 of FIG. 5 are of two distinct heights; an outer circular perimeter of projections 26 are shorter than an inner circle of projections 27 which are shorter than a single center projection 28. As stated before, the purpose of varying the height of the projections 24 is to achieve residual stress modification on the diamond table surface where loading occurs.

Figure 6:
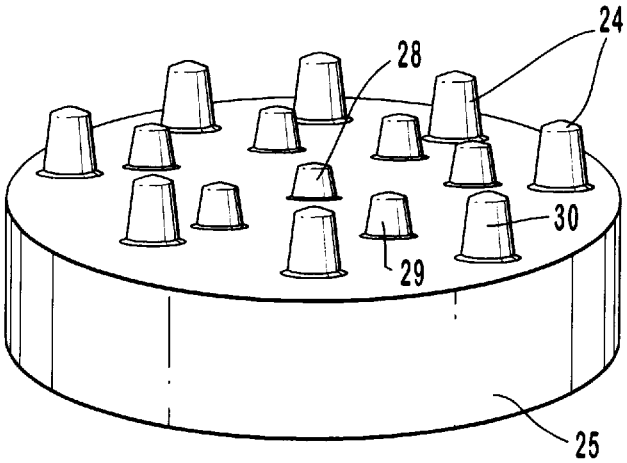
FIG. 6 is a perspective,. phantom view illustrating an alternate embodiment of the carbide substrate seen in FIG. 4.

FIG. 6 shows an alternative embodiment of the present invention. The projections 24 are again varied in height, but opposite from the arrangement of FIG. 5. In other words, the single center projection 28 is shorter than a first circle of projections 29, which are shorter than an outer circle of projections 30, enabling the composite body to achieve stress modification in three dimensions.

Figure 7:
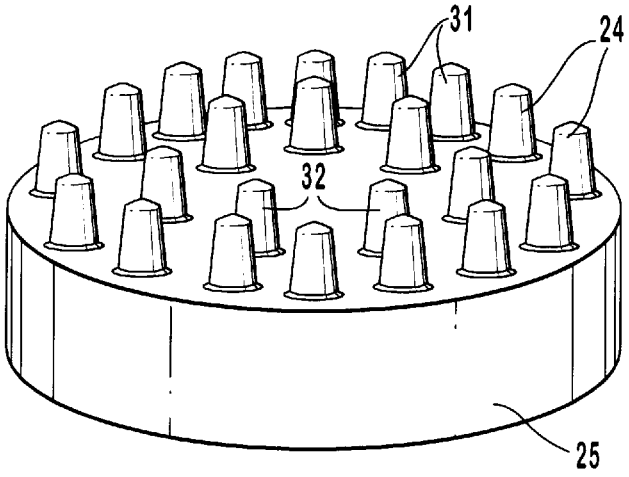
FIG. 7 is a perspective, phantom view illustrating an alternate embodiment of the carbide substrate seen in FIG. 3.

FIG. 7 illustrates another embodiment of the present invention. In this arrangement of projections 24, they are all of uniform height. However, the density of projections 24 has been modified. As shown, an outer circle of projections 31 is constructed with smaller spaces between projections 31 than between the inner circle of projections 32. The residual stress is thereby modified in two dimensions, and not in three.

Figure 8:
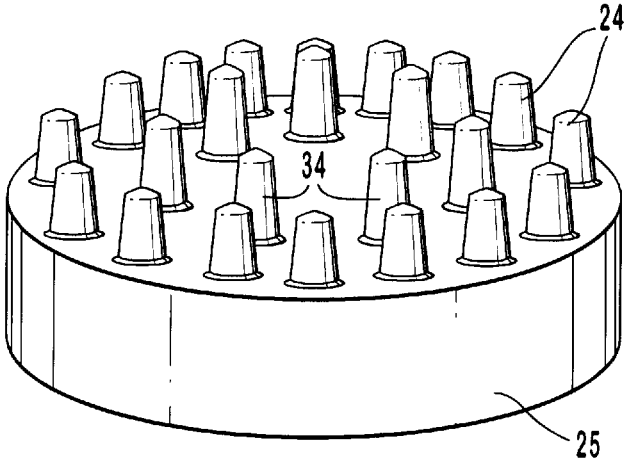
FIG. 8 is a perspective, phantom view illustrating an alternate embodiment of the carbide substrate seen in FIG. 4.

FIG. 8 illustrates a modification to the embodiment of FIG. 7. Instead of only modifying residual stress in two dimensions, the less concentrated pattern of projections 34 of the inner circle also increase in height so as to have a greater impact on the diamond surface.

Figure 9A:
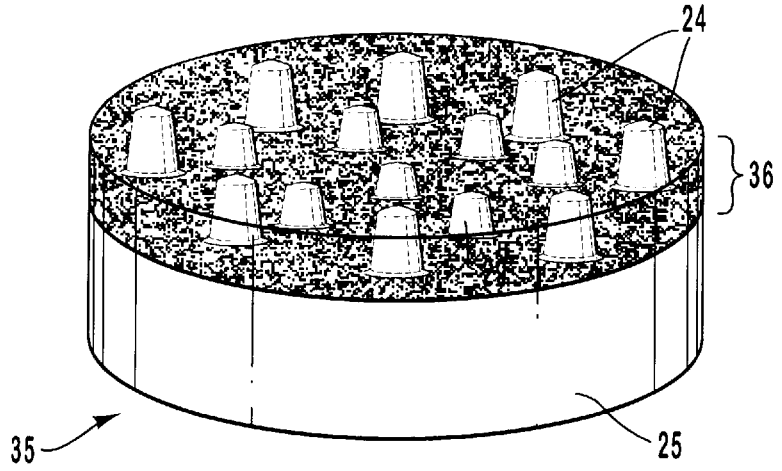
FIG. 9A is a perspective, phantom view illustrating a final composite body with a polycrystalline diamond layer sintered onto the carbide substrate.

FIG. 9A illustrates a final composite body 35 made in accordance to the specifications of the present invention. The projections 24 are arranged as shown in FIG. 6, with the projections 24 gradually increasing in height the further they are from the center of the carbide face, and the height 36 of the sintered diamond layer exceeding the height of the projection 24.

Figure 9B:
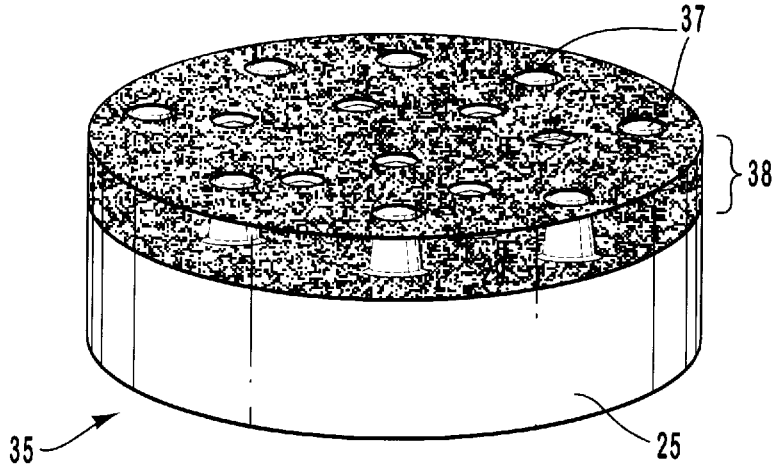
FIG. 9B is a perspective, phantom view illustrating an alternative embodiment of the final composite body of FIG. 9A.

FIG. 9B illustrates a final composite body 35 made in accordance to the specifications of FIG. 9A. However, the tallest carbide projections 37 are exposed through the surface of the sintered diamond layer 38. This embodiment is created by diamond lapping sufficient to expose the highest carbide projections 37 in the outermost circle of projections 24. The exposed projections 37 act as crack arresters. The composite body 35 is then finished by grinding the outside diameter to the required final dimensions as before.

Figure 10:
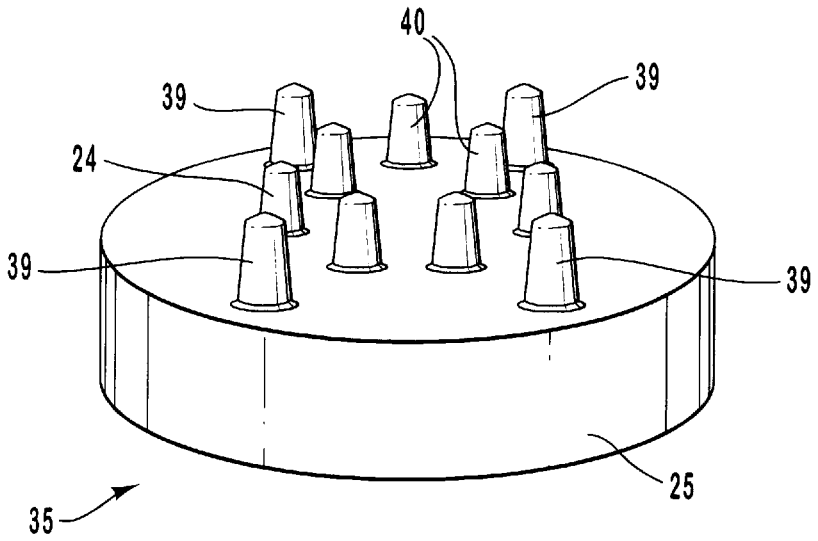
FIG. 10 is a perspective, phantom view illustrating an alternative embodiment of the carbide substrate seen in FIG. 3.

FIG. 10 is provided to show an alternative configuration of projections 24 from the carbide substrate 25. In this embodiment, the projections 39 on the outer edge of the substrate 25 are less numerous and arranged further apart than projections 40 closer to the center of the body 35, but all projections 24 are of equal height.

Figure 11:
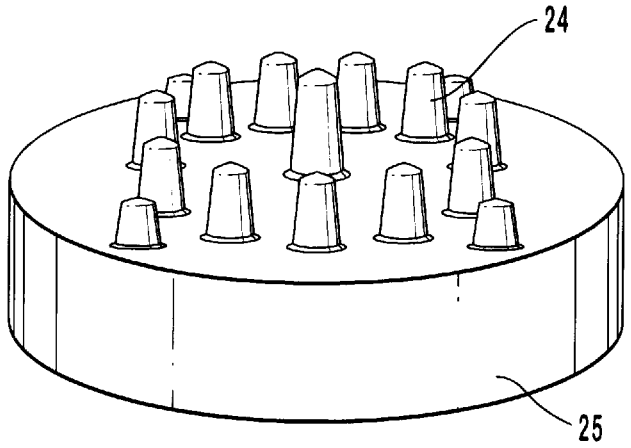
FIG. 11 is a perspective, phantom view illustrating an alternative embodiment of the carbide substrate seen in FIG. 5.

FIG. 11 is provided to show another alternative embodiment of the present invention. Here, the projections 24 increase in height and concentration closer to the center of the substrate 25.

Figure 12:
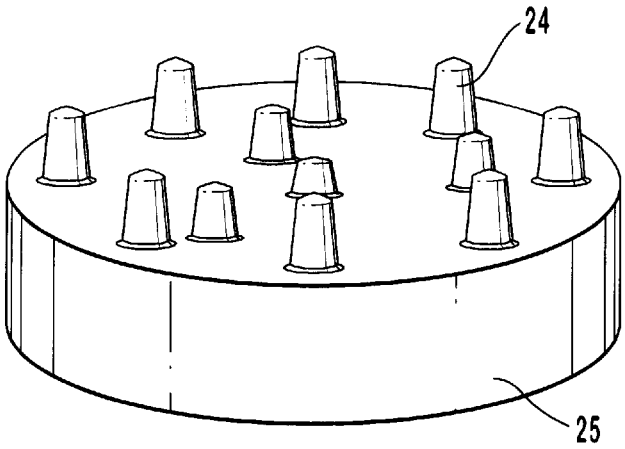
FIG. 12 is a perspective, phantom view illustrating an alternative embodiment of the carbide substrate seen in FIG. 6.

FIG. 12 is provided to show a different alternative embodiment of the present invention. The projections 24 now decrease in height and concentration closer to the center of the substrate 25.

Figure 13:
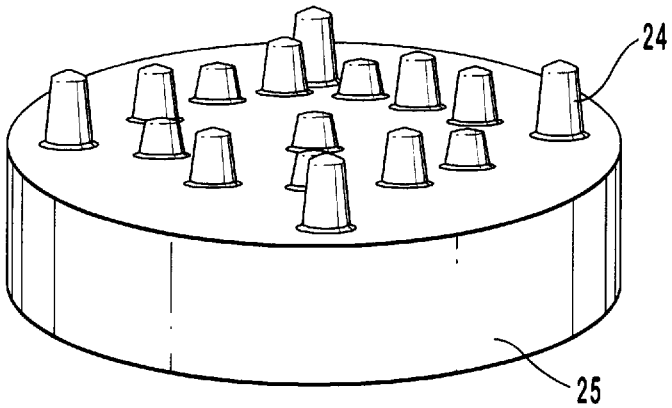
FIG. 13 is a perspective, phantom view illustrating an alternative embodiment of the carbide substrate seen in FIG. 12.

FIG. 13 provides another embodiment of the present invention. The projections 24 now decrease in height but increase in concentration closer to the center of the substrate 25.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. A device for cutting and drilling, wherein the device comprises:

a substrate having a base plane with a plurality of substantially cylindrical projections protruding substantially perpendicular therefrom, where the projections are disposed generally in a nonlinear pattern across said base plane, having a base fixed to said substrate, a sidewall projecting upward from the base, and a top surface having a substantially convex shape; and a polycrystalline material sintered onto the substrate base plane and cylindrical projections, having a cutting surface and an opposed mounting surface, the mounting surface having a plurality of complementary depressions for receiving the plurality of projections on the support surface, said mounting surface being fixed to said base plane and cylindrical projections.

2. The device as defined in claim 1 wherein the substrate and the projections on said substrate are comprised of carbide.

3. The device as defined in claim 1 wherein the sidewall of the projections taper so as to be wider at the base than at the top surface thereof.

4. The device as defined in claim 3 wherein the taper of the sidewall of the projections generally varies between 5 and 20 degrees from vertical.

5. The device as defined in claim 1 wherein the top surface of the projections is generally rounded.

6. The device as defined in claim 1 wherein the base of the projections is beveled for a smooth transition between the sidewall and the substrate support surface.

7. The device as defined in claim 1 wherein the projections extend at least 0.010 inches in height above the substrate support surface.

8. The device as defined in claim 7 wherein the top surface of the projections is tangential to the cutting surface.

9. The device as defined in claim 7 wherein the top surface of the projections is below the cutting surface.

10. The device as defined in claim 1 wherein the projections are all of substantially equal height, and are distributed in a random pattern across the substrate support surface.

11. The device as defined in claim 1 wherein the polycrystalline material further comprises a layer of cubic boron nitride.

12. The device as defined in claim 1 wherein the plurality of projections are distributed across the substrate support surface in a substantially concentric series of at least two rings.

13. The device as defined in claim 12 wherein the plurality of projections are distributed with substantially equidistant space between projections in the rings, and wherein each consecutive ring of projections decreases in height toward a center of the substrate support surface.

14. The device as defined in claim 12 wherein the plurality of projections are distributed with substantially equidistant space between projections in the rings, and wherein each consecutive ring of projections increases in height toward a center of the substrate support surface.

15. The device as defined in claim 12 wherein distribution density of the plurality of projections increases in rings nearer the center of the substrate support surface, and the projections are of substantially equal height.

16. The device as defined in claim 12 wherein distribution density of the plurality of projections decreases in rings nearer the center of the substrate support surface, and projections are of substantially equal height.

17. The device as defined in claim 12 wherein distribution density and height of the plurality of projections increases in rings nearer the center of the substrate support surface.

18. The device as defined in claim 12 wherein distribution density and height of the plurality of projections decreases in rings nearer the center of the substrate support surface.

19. The device as defined in claim 12 wherein distribution density of the plurality of projections decreases while the height of the plurality of projections increases in the rings nearer to the center of the substrate support surface.

20. The device as defined in claim 12 wherein distribution density of the plurality of projections increases while the height of the plurality of projections decreases in the rings nearer to the center of the substrate support surface.

21. The device as defined in claim 12 wherein the plurality of projections are covered by the polycrystalline material so as to leave no portion of said projections exposed.

22. The device as defined in claim 12 wherein at least one of the plurality of projections completely penetrates so as to be exposed on the cutting surface of the polycrystalline material.

23. A method for creating a transition zone in a composite body used for cutting or drilling, and comprising a polycrystalline diamond cutting surface and a carbide substrate, wherein residual stress within the transition zone is modified so as to increase a load bearing capacity of the composite body, comprising the steps of:

a) providing a carbide substrate;

b) forming a plurality of carbide projections attached and perpendicular to a top surface of the carbide substrate, wherein said top surface of the carbide substrate is otherwise planar, wherein the projections are substantially cylindrical and have a top which is generally convex, so as to be easily removed from a die, and wherein the projections modify residual stress so as to increase load bearing capacity of the composite body; and c) sintering a polycrystalline diamond layer to the carbide substrate such that the carbide projections are covered by the polycrystalline diamond layer; wherein said sintering occurs in an ultra-high pressure/high temperature apparatus.

24. The method for modifying residual stresses within a composite body as defined in claim 23, wherein modifying the residual stress includes the step of using the plurality of projections to modify tensile and compression stresses created in manufacturing.

25. The method for modifying residual stress within a composite body as defined in claim 24, wherein modifying the residual stress includes the further step of using the plurality of projections to reduce tensile stress created in manufacturing.

26. The method for modifying residual stress within a composite body as defined in claim 24, wherein modifying the residual stress includes the further step of using the plurality of projections to reduce tensile stress in a core of the carbide substrate and on an outer perimeter of the composite body just below the transition zone.

27. The method for modifying residual stress within a composite body as defined in claim 23, wherein the step of manufacturing a plurality of carbide projections includes the further step of forming the plurality of carbide projections with rounded edges so as to prevents cracks from developing in the composite body.

28. The method for modifying residual stress within a composite body as defined in claim 23, wherein the step of forming a plurality of carbide projections includes the further step of varying a pattern of distribution, density within the distribution, and height of the plurality of carbide projections so as to achieve a desired residual stress distribution in the composite body.

29. The method for modifying residual stress within a composite body as defined in claim 23, wherein the step of forming a plurality of carbide projections includes the further step of varying a pattern of distribution, density within the distribution, thickness and height of the plurality of carbide projections so as to achieve a desired residual stress distribution in the composite body.

* * * * *